US009015039B2

(12) United States Patent
Gao

(10) Patent No.: US 9,015,039 B2
(45) Date of Patent: Apr. 21, 2015

(54) ADAPTIVE ENCODING PITCH LAG FOR VOICED SPEECH

(71) Applicant: Huawei Technologies Co., Ltd., Shenzhen (CN)

(72) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 202 days.

(21) Appl. No.: 13/724,700

(22) Filed: Dec. 21, 2012

(65) Prior Publication Data

US 2013/0166287 A1 Jun. 27, 2013

Related U.S. Application Data

(60) Provisional application No. 61/578,391, filed on Dec. 21, 2011.

(51) Int. Cl.
*G10L 21/00* (2013.01)
*G10L 25/00* (2013.01)
(Continued)

(52) U.S. Cl.
CPC *G10L 19/09* (2013.01); *G10L 19/18* (2013.01)

(58) Field of Classification Search
CPC ..... G10L 25/90; G10L 21/013; G10L 21/02; G10L 19/0212; G10L 19/09; G10L 2025/906; G10L 19/12; G10L 25/93; G10L 19/20; G10L 19/02; G10L 19/097; G10L 19/107; G10L 19/18; G10L 21/0205; G10H 1/366; G10H 2210/331; G10H 2240/251; G10H 2210/066; G10H 2210/251; G10H 2210/031; G10H 2210/056
USPC ..... 704/207, 200, 216, E19.029
See application file for complete search history.

(56) References Cited

U.S. PATENT DOCUMENTS 5,414,796 A * 5/1995 Jacobs et al. ..... 704/221
5,778,334 A 7/1998 Ozawa et al.
(Continued)

FOREIGN PATENT DOCUMENTS

EP 745971 A2 * 12/1996 ..... G10L 9/14
WO 0223531 A1 3/2002

OTHER PUBLICATIONS

Notification of Transmittal of the International Search Report and the Written Opinion of the International Searching Authority, or the Declaration for PCT/US12/71435, mailed Mar. 5, 2013, 8 pages.
(Continued)

*Primary Examiner* — Edgar Guerra-Erazo
(74) *Attorney, Agent, or Firm* — Slater & Matsil, L.L.P.

(57) ABSTRACT

System and method embodiments for dual modes pitch coding are provided. The system and method embodiments are configured to adaptively code pitch lags of a voiced speech signal using one of two pitch coding modes according to a pitch length, stability, or both. The two pitch coding modes include a first pitch coding mode with relatively high precision and reduced dynamic range, and a second pitch coding mode with relatively large dynamic range and reduced precision. The first pitch coding mode is used upon determining that the voiced speech signal has a relatively short or substantially stable pitch. The second pitch coding mode is used upon determining that the voiced speech signal has a relatively long or less stable pitch or is a substantially noisy signal.

25 Claims, 5 Drawing Sheets

(51) Int. Cl.

| | |
|---|---|
| ***G10L 19/00*** | (2013.01) |
| ***G10L 19/09*** | (2013.01) |
| *G10L 19/18* | (2013.01) |

(56) References Cited

U.S. PATENT DOCUMENTS

| | | | | |
|---|---|---|---|---|
| 5,884,251 | A * | 3/1999 | Kim et al. | 704/219 |
| 5,893,060 | A * | 4/1999 | Honkanen et al. | 704/258 |
| 6,397,178 | B1 * | 5/2002 | Benyassine | 704/230 |
| 6,507,814 | B1 * | 1/2003 | Gao | 704/220 |
| 6,574,593 | B1 * | 6/2003 | Gao et al. | 704/222 |
| 6,604,070 | B1 * | 8/2003 | Gao et al. | 704/222 |
| 6,691,082 | B1 * | 2/2004 | Aguilar et al. | 704/219 |
| 6,789,059 | B2 * | 9/2004 | Kandhadai et al. | 704/216 |
| 6,988,065 | B1 * | 1/2006 | Yasunaga et al. | 704/219 |
| 6,996,522 | B2 * | 2/2006 | Chen | 704/219 |
| 7,752,039 | B2 * | 7/2010 | Bessette | 704/223 |
| 7,848,922 | B1 | 12/2010 | Jabri et al. | |
| 2001/0003812 | A1 | 6/2001 | Ehara et al. | |
| 2003/0200092 | A1 * | 10/2003 | Gao et al. | 704/258 |
| 2006/0074639 | A1 * | 4/2006 | Goudar et al. | 704/207 |
| 2006/0089833 | A1 * | 4/2006 | Su et al. | 704/230 |
| 2007/0136051 | A1 | 6/2007 | Sato et al. | |
| 2007/0136052 | A1 | 6/2007 | Gao et al. | |
| 2009/0319262 | A1 * | 12/2009 | Gupta et al. | 704/207 |
| 2009/0319263 | A1 * | 12/2009 | Gupta et al. | 704/229 |
| 2010/0174534 | A1 * | 7/2010 | Vos | 704/207 |
| 2012/0065980 | A1 * | 3/2012 | Krishnan et al. | 704/262 |

OTHER PUBLICATIONS

European Supplementary Search Report received in EP 12860954, mailed Nov. 28, 2014, 6 pages.

"Digital Cellular Telecommunications System (Phase 2+); Half Rate Speech; Half Rate Speech Transcoding (GSM 06.20 version 5.1.1)," ETS 300 969, 650 Route Des Lucioles; F-06921 Sophia-Antipolis Cedex; France, No. Second Edition, May 1, 1998, pp. 1-48, XP050381837.

* cited by examiner

EXAMPLE OF WIDEBAND SPECTRUM

EXAMPLE OF A REGULAR WIDEBAND SPECTRUM WITH DOUBLING PITCH LAG CODING

ADAPTIVE ENCODING PITCH LAG FOR VOICED SPEECH

This application claims the benefit of U.S. Provisional Application Ser. No. 61/578,391 filed on Dec. 21, 2011, entitled "Adaptively Encoding Pitch Lag For Voiced Speech," which is hereby incorporated herein by reference.

The present invention relates generally to the field of signal coding and, in particular embodiments, to a system and method for adaptively encoding pitch lag for voiced speech.

BACKGROUND

Traditionally, parametric speech coding methods make use of the redundancy inherent in the speech signal to reduce the amount of information to be sent and to estimate the parameters of speech samples of a signal at short intervals. This redundancy can arise from the repetition of speech wave shapes at a quasi-periodic rate and the slow changing spectral envelop of speech signal. The redundancy of speech wave forms may be considered with respect to different types of speech signal, such as voiced and unvoiced. For voiced speech, the speech signal is substantially periodic. However, this periodicity may vary over the duration of a speech segment, and the shape of the periodic wave may change gradually from segment to segment. A low bit rate speech coding could significantly benefit from exploring such periodicity. The voiced speech period is also called pitch, and pitch prediction is often named Long-Term Prediction (LTP). As for unvoiced speech, the signal is more like a random noise and has a smaller amount of predictability.

SUMMARY OF THE INVENTION

In accordance with an embodiment, a method for dual modes pitch coding implemented by an apparatus for speech/audio coding includes coding pitch lags of a plurality of subframes of a frame of a voiced speech signal using one of two pitch coding modes according to a pitch length, stability, or both. The two pitch coding modes include a first pitch coding mode with relatively high pitch precision and reduced dynamic range and a second pitch coding mode with relatively high pitch dynamic range and reduced precision.

In accordance with another embodiment, a method for dual modes pitch coding implemented by an apparatus for speech/audio coding includes determining whether a voiced speech signal has one of a relatively short pitch and a substantially stable pitch or one of a relatively long pitch and a relatively less stable pitch or is a substantially noisy signal. The method further includes coding pitch lags of the voiced speech signal with relatively high pitch precision and reduced dynamic range upon determining that the voiced speech signal has a relatively short or substantially stable pitch, or coding pitch lags of the voiced speech signal with relatively high pitch dynamic range and reduced precision upon determining that the voiced speech signal has a relatively long or less stable pitch or is a substantially noisy signal.

In yet another embodiment, an apparatus that supports dual modes pitch coding, includes a processor and a computer readable storage medium storing programming for execution by the processor. The programming including instructions to determine whether a voiced speech signal has one of a relatively short pitch and a substantially stable pitch or has one of a relatively long pitch and a relatively less stable pitch or is a substantially noisy signal, and code pitch lags of the voiced speech signal with relatively high precision and reduced dynamic range upon determining that the voiced speech signal has a relatively short or substantially stable pitch, or coding pitch lags of the voiced speech signal with relatively large dynamic range and reduced precision upon determining that the voiced speech signal has a relatively long or less stable pitch or is a substantially noisy signal.

BRIEF DESCRIPTION OF THE DRAWINGS

For a more complete understanding of the present invention, and the advantages thereof, reference is now made to the following descriptions taken in conjunction with the accompanying drawing, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

For either voiced or unvoiced speech case, parametric coding may be used to reduce the redundancy of the speech segments by separating the excitation component of speech signal from the spectral envelop component. The slowly changing spectral envelope can be represented by Linear Prediction Coding (LPC), also called Short-Term Prediction (STP). A low bit rate speech coding could also benefit from exploring such a Short-Term Prediction. The coding advantage arises from the slow rate at which the parameters change. Further, the voice signal parameters may not be significantly different from the values held within few milliseconds. At the sampling rate of 8 kilohertz (kHz), 12.8 kHz or 16 kHz, the speech coding algorithm is such that the nominal frame duration is in the range of ten to thirty milliseconds. A frame duration of twenty milliseconds may be a common choice. In more recent well-known standards, such as G.723.1, G.729, G.718, EFR, SMV, AMR, VMR-WB or AMR-WB, a Code Excited Linear Prediction Technique (CELP) has been adopted. CELP is a technical combination of Coded Excitation, Long-Term Prediction and Short-Term Prediction. CELP Speech Coding is a very popular algorithm principle in speech compression area although the details of CELP for different codec could be significantly different.

Figure 1:
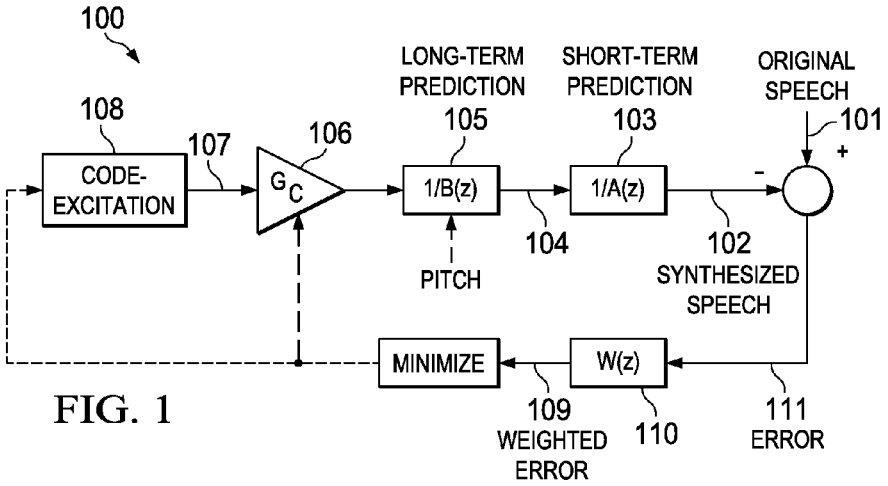
FIG. 1 is a block diagram of a Code Excited Linear Prediction Technique (CELP) encoder.

FIG. 1 shows an example of a CELP encoder 100, where a weighted error 109 between a synthesized speech signal 102 and an original speech signal 101 may be minimized by using an analysis-by-synthesis approach. The CLP encoder 100 performs different operations or functions. The function W(z) corresponds is achieved by an error weighting filter 110. The function 1/B(z) is achieved by a long-term linear prediction filter 105. The function 1/A(z) is achieved by a short-term linear prediction filter 103. A coded excitation 107 from a coded excitation block 108, which is also called fixed codebook excitation, is scaled by a gain $G_c$ 106 before passing through the subsequent filters. A short-term linear prediction filter 103 is implemented by analyzing the original signal 101 and represented by a set of coefficients:

$$A(z) = \sum_{i=1}^{P} 1 + a_i \cdot z^{-i},\ i = 1, 2, \ldots, P \tag{1}$$

The error weighting filter 110 is related to the above short-term linear prediction filter function. A typical form of the weighting filter function could be $$W(z) = \frac{A(z/\alpha)}{1 - \beta \cdot z^{-1}}, \tag{2}$$

where $\beta<\alpha$, $0<\beta<1$, and $0<\alpha\leq 1$. The long-term linear prediction filter 105 depends on signal pitch and pitch gain. A pitch can be estimated from the original signal, residual signal, or weighted original signal. The long-term linear prediction filter function can be expressed as $$B(z)=1-G_p \cdot z^{-Pitch} \tag{3}$$

The coded excitation 107 from the coded excitation block 108 may consist of pulse-like signals or noise-like signals, which are mathematically constructed or saved in a codebook. A coded excitation index, quantized gain index, quantized long-term prediction parameter index, and quantized short-term prediction parameter index may be transmitted from the encoder 100 to a decoder.

Figure 2:
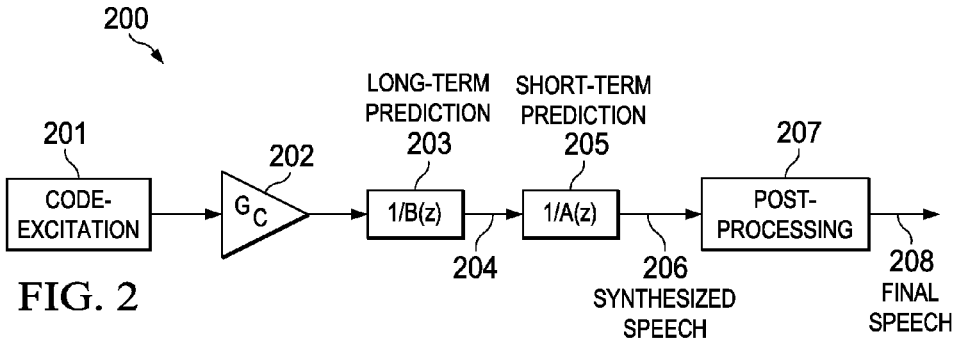
FIG. 2 is a block diagram of a decoder corresponding to the CELP encoder of FIG. 1.

FIG. 2 shows an example of a decoder 200, which may receive signals from the encoder 100. The decoder 200 includes a post-processing block 207 that outputs a synthesized speech signal 206. The decoder 200 comprises a combination of multiple blocks, including a coded excitation block 201, a long-term linear prediction filter 203, a short-term linear prediction filter 205, and a post-processing block 207. The blocks of the decoder 200 are configured similar to the corresponding blocks of the encoder 100. The post-processing block 207 may comprise short-term post-processing and long-term post-processing functions.

Figure 3:
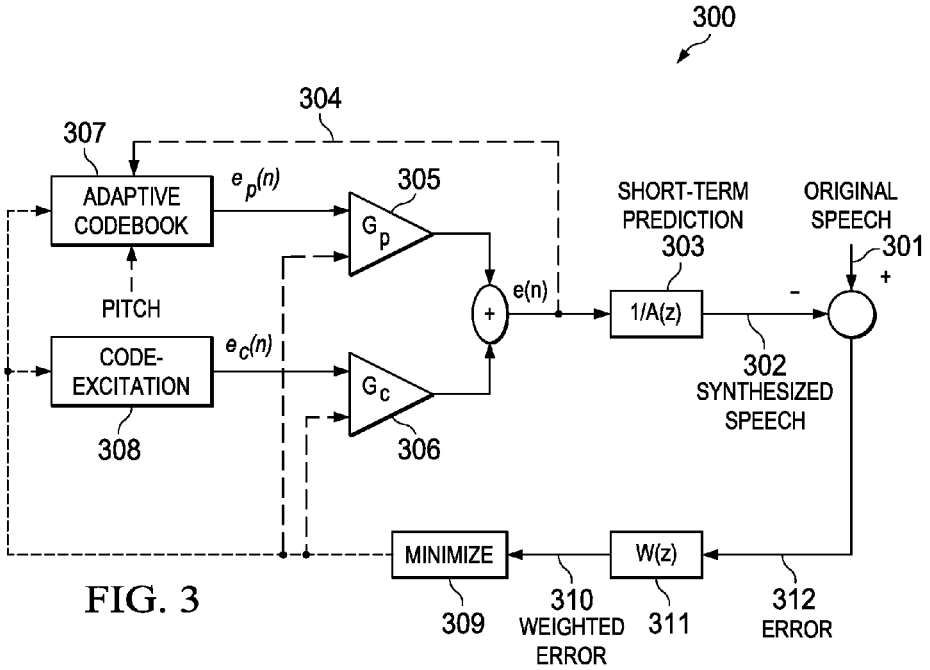
FIG. 3 is a block diagram of another CELP encoder with an adaptive component.

FIG. 3 shows another CELP encoder 300 which implements long-term linear prediction by using an adaptive codebook block 307. The adaptive codebook block 307 uses a past synthesized excitation 304 or repeats a past excitation pitch cycle at a pitch period. The remaining blocks and components of the encoder 300 are similar to the blocks and components described above. The encoder 300 can encode a pitch lag in integer value when the pitch lag is relatively large or long. The pitch lag may be encoded in a more precise fractional value when the pitch is relatively small or short. The periodic information of the pitch is used to generate the adaptive component of the excitation (at the adaptive codebook block 307). This excitation component is then scaled by a gain $G_p$ 305 (also called pitch gain). The two scaled excitation components from the adaptive codebook block 307 and the coded excitation block 308 are added together before passing through a short-term linear prediction filter 303. The two gains ($G_p$ and $G_c$) are quantized and then sent to a decoder.

Figure 4:
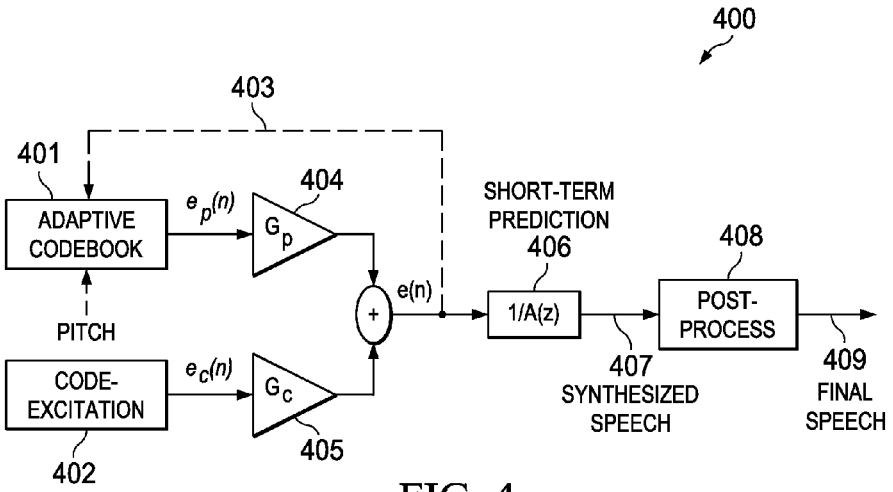
FIG. 4 is a block diagram of another decoder corresponding to the CELP encoder of FIG. 3.

FIG. 4 shows a decoder 400, which may receive signals from the encoder 300. The decoder 400 includes a post-processing block 408 that outputs a synthesized speech signal 407. The decoder 400 is similar to the decoder 200 and the components of the decoder 400 may be similar to the corresponding components of the decoder 200. However, the decoder 400 comprises an adaptive codebook block 307 in addition to a combination of other blocks, including a coded excitation block 402, an adaptive codebook 401, a short-term linear prediction filter 406, and post-processing block 408. The post-processing block 408 may comprise short-term post-processing and long-term post-processing functions. Other blocks are similar to the corresponding components in the decoder 200.

Long-Term Prediction can be effectively used in voiced speech coding due to the relatively strong periodicity nature of voiced speech. The adjacent pitch cycles of voiced speech may be similar to each other, which means mathematically that the pitch gain $G_p$ in the following excitation expression is relatively high or close to 1, $$e(n)=G_p \cdot e_p(n)+G_c \cdot e_c(n) \tag{4}$$

where $e_p(n)$ is one subframe of sample series indexed by n, and sent from the adaptive codebook block 307 or 401 which uses the past synthesized excitation 304 or 403. The parameter $e_p(n)$ may be adaptively low-pass filtered since low frequency area may be more periodic or more harmonic than high frequency area. The parameter $e_c(n)$ is sent from the coded excitation codebook 308 or 402 (also called fixed codebook), which is a current excitation contribution. The parameter $e_c(n)$ may also be enhanced, for example using high pass filtering enhancement, pitch enhancement, dispersion enhancement, formant enhancement, etc. For voiced speech, the contribution of $e_p(n)$ from the adaptive codebook block 307 or 401 may be dominant and the pitch gain $G_p$ 305 or 404 is around a value of 1. The excitation may be updated for each subframe. For example, a typical frame size is about 20 milliseconds and a typical subframe size is about 5 milliseconds.

Figure 5:
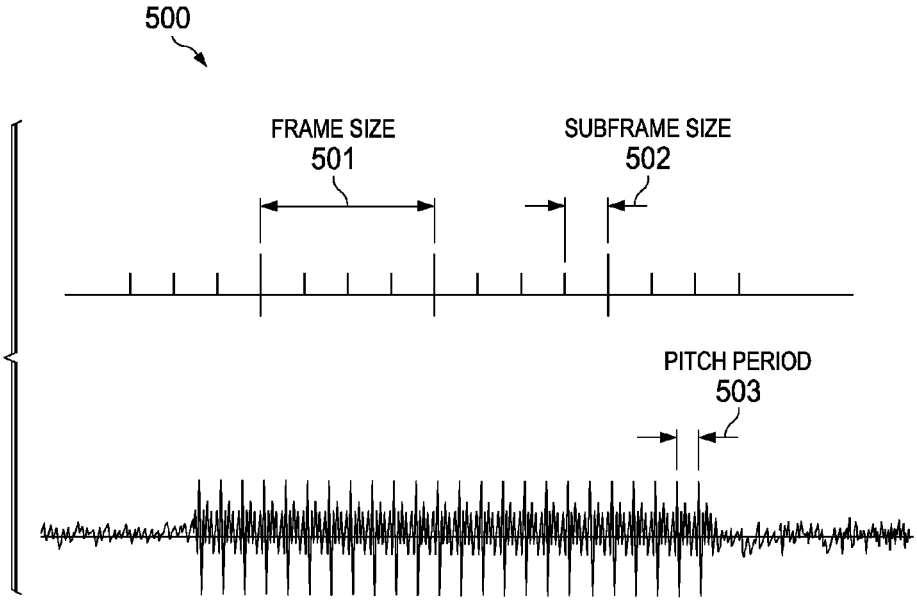
FIG. 5 is an example of a voiced speech signal where a pitch period is smaller than a subframe size and a half frame size.
Figure 6:
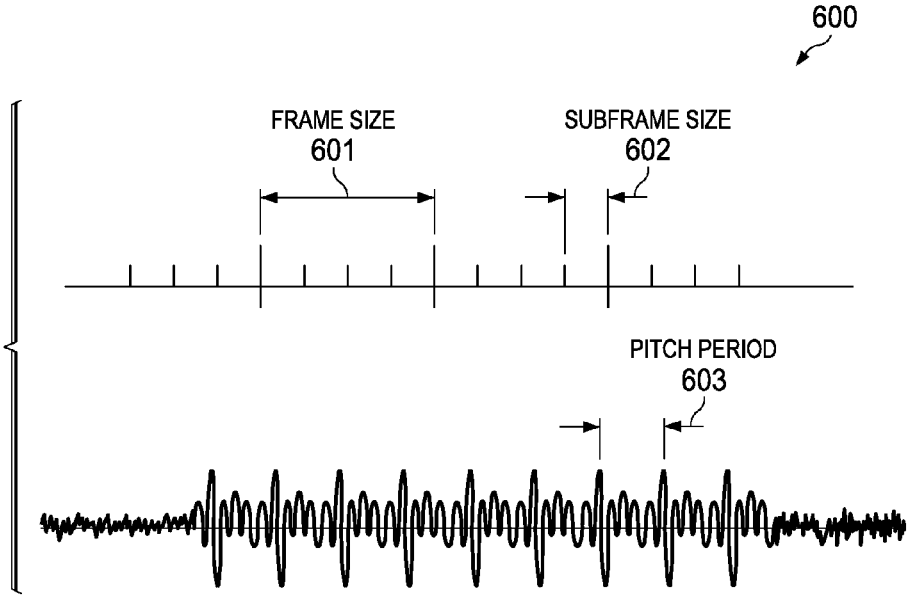
FIG. 6 is an example of a voiced speech signal where a pitch period is larger than a subframe size and smaller than a half frame size.

For typical voiced speech signals, one frame may comprise more than 2 pitch cycles. FIG. 5 shows an example of a voiced speech signal 500, where a pitch period 503 is smaller than a subframe size 502 and a half frame size 501. FIG. 6 shows another example of a voiced speech signal 600, where a pitch period 603 is larger than a subframe size 602 and smaller than a half frame size 601.

The CELP is used to encode speech signal by benefiting from human voice characteristics or human vocal voice production model. The CELP algorithm has been used in various ITU-T, MPEG, 3GPP, and 3GPP2 standards. To encode speech signals more efficiently, speech signals may be classified into different classes, where each class is encoded in a different way. For example, in some standards such as G.718, VMR-WB or AMR-WB, speech signals arr classified into UNVOICED, TRANSITION, GENERIC, VOICED, and NOISE classes of speech. For each class, a LPC or STP filter is used to represent a spectral envelope, but the excitation to the LPC filter may be different. UNVOICED and NOISE classes may be coded with a noise excitation and some excitation enhancement. TRANSITION class may be coded with a pulse excitation and some excitation enhancement without using adaptive codebook or LTP. GENERIC class may be coded with a traditional CELP approach, such as Algebraic CELP used in G.729 or AMR-WB, in which one 20 millisecond (ms) frame contains four 5 ms subframes. Both the adaptive codebook excitation component and the fixed codebook excitation component are produced with some excitation enhancement for each subframe. Pitch lags for the adaptive codebook in the first and third subframes are coded in a full range from a minimum pitch limit PIT_MIN to a maximum pitch limit PIT_MAX, and pitch lags for the adaptive codebook in the second and fourth subframes are coded differentially from the previous coded pitch lag. VOICED class may be coded slightly different from GNERIC class, in which the pitch lag in the first subframe is coded in a full range from a minimum pitch limit PIT_MIN to a maximum pitch limit PIT_MAX, and pitch lags in the other subframes are coded differentially from the previous coded pitch lag. For example, assuming an excitation sampling rate of 12.8 kHz, the PIT_MIN value can be 34 and the PIT_MAX value can be 231.

CELP codecs (encoders/decoders) work efficiently for normal speech signals, but low bit rate CELP codecs may fail for music signals and/or singing voice signals. For stable voiced speech signals, the pitch coding approach of VOICED class can provide better performance than the pitch coding approach of GENERIC class by reducing the bit rate to code pitch lags with more differential pitch coding. However, the pitch coding approach of VOICED class may still have two problems. First, the performance is not good enough when the real pitch is substantially or relatively very short, for example, when the real pitch lag is smaller than PIT_MIN. Second, when the available number of bits for coding is limited, a high precision pitch coding may result in a substantially small pitch dynamic range. Alternatively, due to the limited coding bits, a high pitch dynamic range may cause a relatively low precision pitch coding. For example, 4 bits pitch differential coding can have a ¼ sample precision but only a +−2 samples dynamic range. Alternatively, 4 bits pitch differential coding can have a +−4 samples dynamic range but only a ½ sample precision.

Regarding the first problem of the pitch coding of VOICED class, a pitch range from PIT_MIN=34 to PIT_MAX=231 for $F_s$=12.8 kHz sampling frequency may adapt to various human voices. However, the real pitch lag of typical music or singing voiced signals can be substantially shorter than the minimum limitation PIT_MIN=34 defined in the CELP algorithm. When the real pitch lag is P, the corresponding fundamental harmonic frequency is $F0=F_s/P$, where $F_s$ is the sampling frequency and F0 is the location of the first harmonic peak in spectrum. Thus, the minimum pitch limitation PIT_MIN may actually define the maximum fundamental harmonic frequency limitation $F_{MIN}=F_s$/PIT_MIN for the CELP algorithm.

Figure 7:
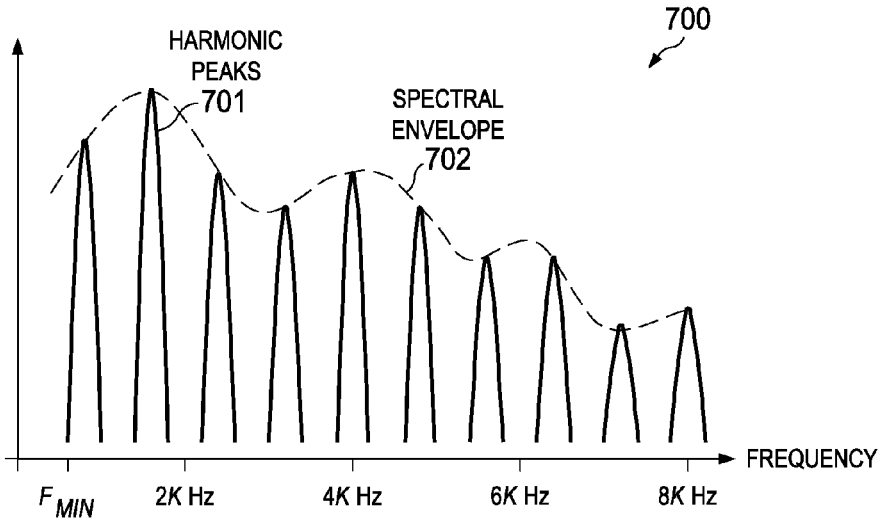
FIG. 7 shows an example of a spectrum of a voiced speech signal.
Figure 8:
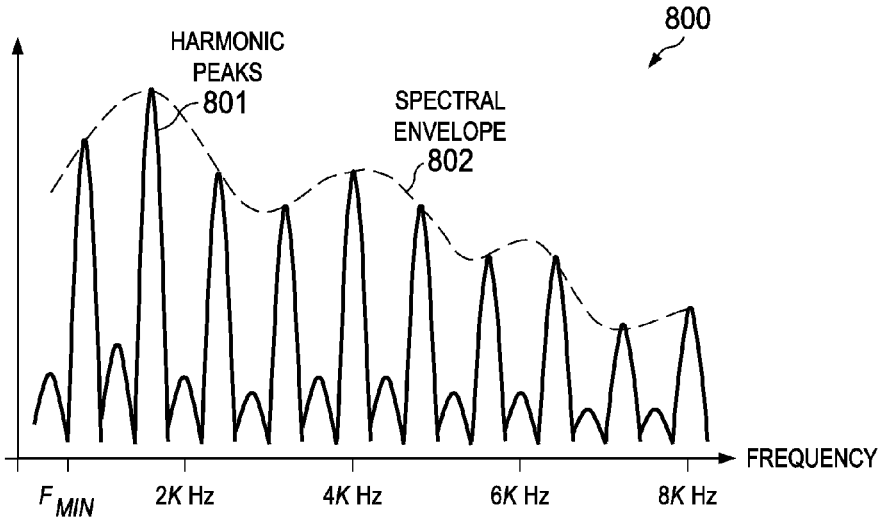
FIG. 8 shows an example of a spectrum of the same signal of FIG. 7 with doubling pitch lag coding.

FIG. 7 shows an example of a spectrum 700 of a voiced speech signal comprising harmonic peaks 701 and a spectral envelope 702. The real fundamental harmonic frequency (the location of the first harmonic peak) is already beyond the maximum fundamental harmonic frequency limitation $F_{MIN}$ such that the transmitted pitch lag for the CELP algorithm is equal to a double or a multiple of the real pitch lag. The wrong pitch lag transmitted as a multiple of the real pitch lag can cause quality degradation. In other words, when the real pitch lag for a harmonic music signal or singing voice signal is smaller than the minimum lag limitation PIT_MIN defined in CELP algorithm, the transmitted lag may be double, triple or multiple of the real pitch lag. FIG. 8 shows an example of a spectrum 800 of the same signal with doubling pitch lag coding (the coded and transmitted pitch lag is double of the real pitch lag). The spectrum 800 comprises harmonic peaks 801, a spectral envelope 802, and unwanted small peaks between the real harmonic peaks. The small spectrum peaks in FIG. 8 may cause uncomfortable perceptual distortion.

Regarding the second problem of the pitch coding of VOICED class, relatively short pitch signals or substantially stable pitch signals can have good quality when high precision pitch coding is guaranteed. However, relatively long pitch signals, less stable pitch signals or substantially noisy signals may have degraded quality due to the limited dynamic range. In other words, when the dynamic range of pitch coding is relatively high, the long pitch signals, less stable pitch signals or substantially noisy signals can have good quality, but relatively short pitch signals or stable pitch signals may have degraded quality due to the limited pitch precision.

System and method embodiments are provided herein for avoiding the two potential problems of the pitch coding for VOICED class. The system and method embodiments are configured to adaptively code the pitch lag for dual modes, where each pitch coding mode defines a pitch coding precision or dynamic range differently. One pitch coding mode comprises coding a relatively short pitch signal or stable pitch signal. Another pitch coding mode comprises coding a relatively long pitch signal, less stable pitch signal, or substantially noisy signal. The details of the dual modes coding are described below.

Typically, music harmonic signals or singing voice signals are more stationary than normal speech signals. The pitch lag (or fundamental frequency) of a normal speech signal may keep changing over time. However, the pitch lag (or fundamental frequency) of music signals or singing voice signals may change relatively slowly over relatively long time duration. For relatively short pitch lag, it is useful to have a precise pitch lag for efficient coding purpose. The relatively short pitch lag may change relatively slowly from one subframe to a next subframe. This means that a substantially large dynamic range of pitch coding is not needed when the real pitch lag is substantially short. Typically, a short pitch needs higher precision but less dynamic range than a long pitch. For a stable pitch lag, a relatively large dynamic range of pitch coding is not needed, and hence such pitch coding may be focused on high precision. Accordingly, one pitch coding mode may be configured to define high precision with relatively less dynamic range. This pitch coding mode is used to code relatively short pitch signals or substantially stable pitch signals having a relatively small pitch difference between a previous subframe and a current subframe. By reducing the dynamic range for pitch coding, one or more bits may be saved in coding the pitch lags for the signal subframes. More of the bits used may be dedicated for ensuring high pitch precision on the expense of pitch dynamic range.

For relatively long pitch signals, less stable pitch signals or substantially noisy signals, the pitch can be coded with less precision and more dynamic range. This is possible since a long pitch lag requires less precision than a short pitch lag but needs more dynamic range. Further, a changing pitch lag may require less precision than a stable pitch lag but needs more dynamic range. For example, when a pitch difference between a previous subframe and a current subframe is 2, a ¼ pitch precision may be already meaningless due to forced constant pitch value within one subframe, which means the assumption of constant pitch value within one subframe is already not precise anyway. Accordingly, the other pitch coding mode defines relatively large dynamic range with less pitch precision, which is used to code long pitch signals, less stable pitch signals or very noisy signals. By reducing the pitch precision for pitch coding, one or more bits may be saved in coding the pitch lags of the signal subframes. More of the bits used may be dedicated for ensuring large pitch dynamic range on the expense of pitch precision.

Figure 9:
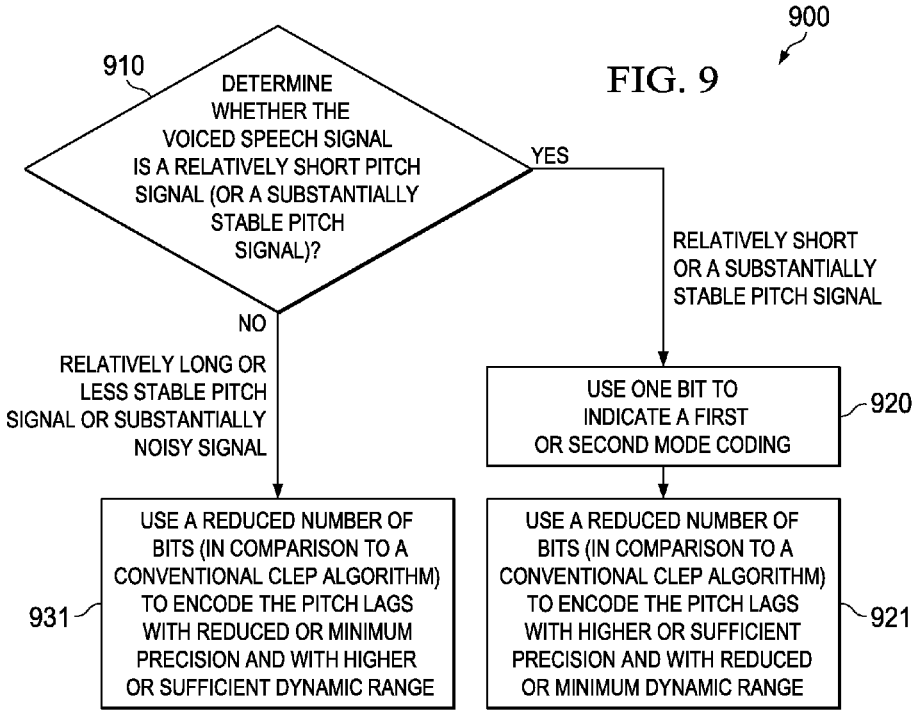
FIG. 9 shows an embodiment method for adaptively encoding pitch lag for dual modes of voiced speech.

FIG. 9 shows an embodiment method 900 for adaptively encoding pitch lag for dual modes of voiced speech. The method 900 may be implemented by an encoder, such as the encoder 300 (or 100). At step 910, the method 900 determines whether the voiced speech signal is a relatively short pitch signal (or a substantially stable pitch signal) or whether the signal is a relatively long pitch signal (or a less stable pitch signal or a substantially noisy signal). An example of a relatively short pitch signal or a substantially stable pitch voiced speech may be a music segment, a singing voice, or a female or child singing voice. The method 900 proceeds to step 921 if the voiced speech signal is a relatively short pitch signal or a substantially stable pitch signal. Alternatively, the method 900 may proceed to step 931 if the voiced speech signal is a relatively long pitch signal, a less stable pitch signal, or a substantially noisy signal.

At step 920, the method 900 uses one bit, for example, to indicate a first pitch coding mode (for relatively short or substantially stable pitch signals) or a second pitch coding mode (for relatively long or less stable pitch signals or substantially noisy signals). The one bit may be set to 0 or 1 to indicate the first pitch coding mode or a second pitch coding mode. At step 921, the method 900 uses a reduced number of bits, e.g., in comparison to a conventional CLEP algorithm according to standards, to encode pitch lags with higher or sufficient precision and with reduced or minimum dynamic range. For example, the method 900 reduces the number of bits in the differential coding of the pitch lag of the subframes subsequent to the first subframe.

At step 931, the method 900 uses a reduced number of bits, e.g., in comparison to a conventional CLEP algorithm according to standards, to encode pitch lags with reduced or minimum precision and with higher or sufficient dynamic range. For example, the method 900 reduces the number of bits in the differential coding of the pitch lags of the subframes subsequent to the first subframe.

If a method for adaptively encoding pitch lags for dual modes of voiced speech is implemented in an encoder, a corresponding method may also be implemented by a corresponding decoder, such as the decoder 400 (or 200). The method includes receiving the voiced speech signal from the encoder and detecting the one bit to determine the pitch coding mode used to encode the voiced speech signal. The method then decodes the pitch lags with higher precision and lower dynamic range if the signal corresponds to the first mode, or decodes the pitch lags with lower precision and higher dynamic range if the signal corresponds to the second mode.

The dual modes pitch coding approach for VOICED class is substantially beneficial for low bit rate coding. In an embodiment, one bit per frame may be used to identify the pitch coding mode. The different examples below include different implementation details for the dual modes pitch coding approach.

In a first example, the voiced speech signal may be coded or encoded using 6800 bits per second (bps) codec at 12.8 kHz sampling frequency. Table 1 shows a typical pitch coding approach for VOICED class with a total number of bits of 23 bits=(8+5+5+5) bits for 4 consecutive subframes respectively.

TABLE 1

Old pitch table for 6.8 kbps codec.

| | | Sub-frame 1 | Sub-frame 2 | Sub-frame 3 | Sub-frame 4 |
|---|---|---|---|---|---|
| Number of Bits | | 8 | 5 | 5 | 5 |
| Pitch 16->34 | Precision | | | | |
| Pitch 16->34 | Dynamic range | | | | |
| Pitch 34->92 | Precision | ½ | ¼ | ¼ | ¼ |
| Pitch 34->92 | Dynamic range | +−4 | +−4 | +−4 | +−4 |
| Pitch 92->231 | Precision | 1 | ¼ | ¼ | ¼ |
| Pitch 92->231 | Dynamic range | +−4 | +−4 | +−4 | +−4 |

Using the dual modes pitch coding approach for VOICED class, the first pitch coding mode defines a substantially stable pitch or short pitch, which satisfies a pitch difference between a previous subframe and a current subframe smaller or equal to 2 with a pitch lag<143 at least for the 2-nd and 3-rd subframes, or a pitch lag substantially short with 16<=pitch lag<=34 for all subframes. If the defined condition is satisfied, the first pitch coding mode encodes the pitch lag with high precision and less dynamic range. Table 2 shows the detailed definition for the first pitch coding mode.

TABLE 2

New pitch table with the first pitch coding mode for 6.8 kbps codec.

| | | Sub-frame 1 | Sub-frame 2 | Sub-frame 3 | Sub-frame 4 |
|---|---|---|---|---|---|
| Number of Bits | | 9 + 1 | 4 | 4 | 5 |
| Pitch 16->143 | Precision | ¼ | ¼ | ¼ | ¼ |
| Pitch 16->143 | Dynamic range | +−4 | +−2 | +−2 | +−4 |
| Pitch 143->231 | Precision | | | | |
| Pitch 143->231 | Dynamic range | | | | |

Other cases that do not satisfy the above first pitch coding mode are classified under a second pitch coding mode for VOICED class. The second pitch coding mode encodes the pitch lag with less precision and relatively large dynamic range. Table 3 shows the detailed definition for the second pitch coding mode.

TABLE 3

New pitch table with the second pitch coding mode for 6.8 kbps codec.

| | | Sub-frame 1 | Sub-frame 2 | Sub-frame 3 | Sub-frame 4 |
|---|---|---|---|---|---|
| Number of Bits | | 9 + 1 | 4 | 4 | 5 |
| Pitch 16->34 | Precision | | | | |
| Pitch 16->34 | Dynamic range | | | | |
| Pitch 34->128 | Precision | ¼ | ½ | ½ | ¼ |
| Pitch 34->128 | Dynamic range | +−4 | +−4 | +−4 | +−4 |
| Pitch 128->160 | Precision | ½ | ½ | ½ | ¼ |
| Pitch 128->160 | Dynamic range | +−4 | +−4 | +−4 | +−4 |
| Pitch 160->231 | Precision | 1 | ½ | ½ | ¼ |
| Pitch 160->231 | Dynamic range | +−4 | +−4 | +−4 | +−4 |

In the above example, the new dual mode pitch coding solution has the same total bit rate as the old one. However, the pitch range from 16 to 34 is encoded without sacrificing the quality of the pitch range from 34 to 231. Tables 2 and 3 can be modified so that the quality is kept or improved compared to the old one while saving the total bit rate. The modified Tables 2 and 3 are named as Table 2.1 and Table 3.1 below.

TABLE 2.1

New pitch table with the first pitch coding mode for 6.8 kbps codec.

| | | Sub-frame 1 | Sub-frame 2 | Sub-frame 3 | Sub-frame 4 |
|---|---|---|---|---|---|
| Number of Bits | | 8 + 1 | 4 | 4 | 4 |
| Pitch 16->34 | Precision | | | | |
| Pitch 16->34 | Dynamic range | | | | |
| Pitch 34->98 | Precision | ¼ | ¼ | ¼ | ¼ |
| Pitch 34->98 | Dynamic range | +−4 | +−2 | +−2 | +−2 |
| Pitch 98->231 | Precision | | | | |
| Pitch 98->231 | Dynamic range | | | | |

TABLE 3.1

New pitch table with the second pitch coding mode for 6.8 kbps codec.

| | | Sub-frame 1 | Sub-frame 2 | Sub-frame 3 | Subframe 4 |
|---|---|---|---|---|---|
| Number of Bits | | 8 + 1 | 4 | 4 | 4 |
| Pitch 16->34 | Precision | | | | |
| Pitch 16->34 | Dynamic range | | | | |
| Pitch 34->92 | Precision | ½ | ½ | ½ | ½ |
| Pitch 34->92 | Dynamic range | +−4 | +−4 | +−4 | +−4 |
| Pitch 92->231 | Precision | 1 | ½ | ½ | ½ |
| Pitch 92->231 | Dynamic range | +−4 | +−4 | +−4 | +−4 |

In a second example, the voiced speech signal may be coded using 7600 bps codec at 12.8 kHz sampling frequency. Table 4 shows a typical pitch coding approach for VOICED class with a total number of bits of 20 bits=(8+4+4+4) bits for 4 consecutive subframes respctively.

TABLE 4

Old pitch table for 7.6 kbps codec.

| | | Sub-frame 1 | Sub-frame 2 | Sub-frame 3 | Subframe 4 |
|---|---|---|---|---|---|
| Number of Bits | | 8 | 4 | 4 | 4 |
| Pitch 16->34 | Precision | | | | |
| Pitch 16->34 | Dynamic range | | | | |
| Pitch 34->92 | Precision | ½ | ½ | ½ | ½ |
| Pitch 34->92 | Dynamic range | +−4 | +−4 | +−4 | +−4 |
| Pitch 92->231 | Precision | 1 | ½ | ½ | ½ |
| Pitch 92->231 | Dynamic range | +−4 | +−4 | +−4 | +−4 |

Using the dual modes pitch coding approach for VOICED class, the first pitch coding mode defines a substantially stable pitch or short pitch, which satisfies a pitch difference between a previous subframe and a current subframe smaller or equal to 1 with a pitch lag<143 at least for the 2-nd and 3-rd subframes, or a pitch lag substantially short with 16<=pitch lag<=34 for all subframes. If the defined condition is satisfied, the first pitch coding mode encodes the pitch lag with high precision and less dynamic range. Table 5 shows the detailed definition for the first pitch coding mode.

TABLE 5

New pitch table with the first pitch coding mode for 7.6 kbps codec.

| | | Sub-frame 1 | Sub-frame 2 | Sub-frame 3 | Subframe 4 |
|---|---|---|---|---|---|
| Number of Bits | | 9 + 1 | 3 | 3 | 4 |
| Pitch 16->143 | Precision | ¼ | ¼ | ¼ | ¼ |
| Pitch 16->143 | Dynamic range | +−4 | +−1 | +−1 | +−2 |
| Pitch 143->231 | Precision | | | | |
| Pitch 143->231 | Dynamic range | | | | |

Other cases that do not satisfy the above first pitch coding mode are classified under a second pitch coding mode for VOICED class. The second pitch coding mode encodes the pitch lag with less precision and relatively large dynamic range. Table 6 shows the detailed definition for the second pitch coding mode.

TABLE 6

New pitch table with the second pitch coding mode for 7.6 kbps codec.

| | | Sub-frame 1 | Sub-frame 2 | Sub-frame 3 | Subframe 4 |
|---|---|---|---|---|---|
| Number of Bits | | 9 + 1 | 3 | 3 | 4 |
| Pitch 16->34 | Precision | | | | |
| Pitch 16->34 | Dynamic range | | | | |
| Pitch 34->128 | Precision | ¼ | ½ | ½ | ½ |
| Pitch 34->128 | Dynamic range | +−4 | +−2 | +−2 | +−4 |
| Pitch 128->160 | Precision | ½ | 1 | 1 | ½ |
| Pitch 128->160 | Dynamic range | +−4 | +−4 | +−4 | +−4 |
| Pitch 160->231 | Precision | 1 | 1 | 1 | ½ |
| Pitch 160->231 | Dynamic range | +−4 | +−4 | +−4 | +−4 |

In the above example, the new dual mode pitch coding solution has the same total bit rate as the old one. However, the pitch range from 16 to 34 is encoded without sacrificing the quality of the pitch range from 34 to 231.

In a third example, the voiced speech signal may be coded using 9200 bps, 12800 bps, or 16000 bps codec at 12.8 kHz sampling frequency. Table 7 shows a typical pitch coding approach for VOICED class with a total number of bits of 24 bits=(9+5+5+) bits for 4 consecutive subframes respctively.

TABLE 7

Old pitch table for rate >=9.2 kbps codec.

| | | Sub-frame 1 | Sub-frame 2 | Sub-frame 3 | Subframe 4 |
|---|---|---|---|---|---|
| Number of Bits | | 9 | 5 | 5 | 5 |
| Pitch 16->34 | Precision | | | | |
| Pitch 16->34 | Dynamic range | | | | |
| Pitch 34->128 | Precision | ¼ | ¼ | ¼ | ¼ |
| Pitch 34->128 | Dynamic range | +−4 | +−4 | +−4 | +−4 |
| Pitch 128->160 | Precision | ½ | ¼ | ¼ | ¼ |
| Pitch 128->160 | Dynamic range | +−4 | +−4 | +−4 | +−4 |
| Pitch 160->231 | Precision | 1 | ¼ | ¼ | ¼ |
| Pitch 160->231 | Dynamic range | +−4 | +−4 | +−4 | +−4 |

Using the dual modes pitch coding approach for VOICED class, the first pitch coding mode defines a substantially stable pitch or short pitch, which satisfies a pitch difference between a previous subframe and a current subframe smaller or equal to 2 with a pitch lag <143 at least for the 2-nd subframe, or a pitch lag substantially short with 16<=pitch lag<=34 for all subframes. If the defined condition is satisfied, the first pitch coding mode encodes the pitch lag with high precision and less dynamic range. Table 8 shows the detailed definition for the first pitch coding mode.

TABLE 8

New pitch table with the first pitch coding mode rate >=9.2 kbps codec.

| | | Sub-frame 1 | Sub-frame 2 | Sub-frame 3 | Subframe 4 |
|---|---|---|---|---|---|
| Number of Bits | | 9 + 1 | 4 | 5 | 5 |
| Pitch 16->143 | Precision | ¼ | ¼ | ¼ | ¼ |
| Pitch 16->143 | Dynamic range | +−4 | +−2 | +−4 | +−4 |
| Pitch 143->231 | Precision | | | | |
| Pitch 143->231 | Dynamic range | | | | |

Other cases that do not satisfy the above first pitch coding mode are classified under a second pitch coding mode for VOICED class. The second pitch coding mode encodes the pitch lag with less precision and relatively large dynamic range. Table 9 shows the detailed definition for the second pitch coding mode.

TABLE 9

New pitch table with the second pitch coding mode for rate >=9.2 kbps codec.

| | | Sub-frame 1 | Sub-frame 2 | Sub-frame 3 | Subframe 4 |
|---|---|---|---|---|---|
| Number of Bits | | 9 + 1 | 4 | 5 | 5 |
| Pitch 16->34 | Precision | | | | |
| Pitch 16->34 | Dynamic range | | | | |
| Pitch 34->128 | Precision | ¼ | ½ | ¼ | ¼ |
| Pitch 34->128 | Dynamic range | +−4 | +−4 | +−4 | +−4 |
| Pitch 128->160 | Precision | ½ | ½ | ¼ | ¼ |
| Pitch 128->160 | Dynamic range | +−4 | +−4 | +−4 | +−4 |
| Pitch 160->231 | Precision | 1 | ½ | ¼ | ¼ |
| Pitch 160->231 | Dynamic range | +−4 | +−4 | +−4 | +−4 |

In the above example, the new dual mode pitch coding solution has the same total bit rate as the old one. However, the pitch range from 16 to 34 is encoded without sacrificing or with improving the quality of the pitch range from 34 to 231. Tables 8 and 9 can be modified so that the quality is kept or improved compared to the old one while saving the total bit rate. The modified Tables 8 and 9 are named as Table 8.1 and Table 9.1 below.

TABLE 8.1

New pitch table with the first pitch coding mode rate >=9.2 kbps codec.

| | | Sub-frame 1 | Sub-frame 2 | Sub-frame 3 | Subframe 4 |
|---|---|---|---|---|---|
| Number of Bits | | 9 + 1 | 4 | 4 | 4 |
| Pitch 16->143 | Precision | ¼ | ¼ | ¼ | ¼ |
| Pitch 16->143 | Dynamic range | +−4 | +−2 | +−2 | +−2 |
| Pitch 143->231 | Precision | | | | |
| Pitch 143->231 | Dynamic range | | | | |

TABLE 9.1

New pitch table with the second pitch coding mode for rate >=9.2 kbps codec.

| | | Sub-frame 1 | Sub-frame 2 | Sub-frame 3 | Subframe 4 |
|---|---|---|---|---|---|
| Number of Bits | | 9 + 1 | 4 | 4 | 4 |
| Pitch 16->34 | Precision | | | | |
| Pitch 16->34 | Dynamic range | | | | |
| Pitch 34->128 | Precision | ¼ | ½ | ½ | ½ |
| Pitch 34->128 | Dynamic range | +−4 | +−4 | +−4 | +−4 |
| Pitch 128->160 | Precision | ½ | ½ | ½ | ½ |
| Pitch 128->160 | Dynamic range | +−4 | +−4 | +−4 | +−4 |
| Pitch 160->231 | Precision | 1 | ½ | ½ | ½ |
| Pitch 160->231 | Dynamic range | +−4 | +−4 | +−4 | +−4 |

In an embodiment, a procedure may be implemented (e.g., via software) for dual modes pitch coding decision for low bit-rate codecs, where stab_pit_flag=1 means the first pitch coding mode is set, and stab_pit_flag=0 means the second pitch coding mode is set. In the procedure, the parameters Pit[0], Pit[1], Pit[2], and Pit[3] are estimated pitch lags respectively for the first, second, third and fourth subframes in encoder. The procedure may comprise the following or similar code:

```
/* dual modes pitch coding decision */
Initial :
dpit1 = |Pit[0]−Pit[1]|;
dpit2 = |Pit[1]−Pit[2]|;
dpit3 = |Pit[2]−Pit[3]|;
stab_pit_flag = 0;
if (coder_type=VOICED) {
    if (bit_rate=6800bps) { //for 6800bps
        if (Pit[2]<140 and dpit1<=2.f and dpit2<=2.f and dpit3<4.f) {
            stab_pit_flag = 1;
        }
    }
    else if (bit_rate = 7600bps) { //for 7600bps
        if (Pit[2]<140 and dpit1<=1.f and dpit2<=1.f and dpit3<2.f) {
            stab_pit_flag = 1;
        }
    }
    else { //for 9200bps, 12800bps, and 16000bps
        if (Pit[2]<140 and dpit1<=2.f and dpit2<4.f and dpit3<4.f){
            stab_pit_flag = 1;
        }
    }
}
```

Signal to Noise Ratio (SNR) is one of the objective test measuring methods for speech coding. Weighted Segmental SNR (WsegSNR) is another objective test measuring method, which may be slightly closer to real perceptual quality measuring than SNR. A relatively small difference in SNR or WsegSNR may not be audible, while larger differences in SNR or WsegSNR may more or clearly audible. Table 10 to 15 below show the objective test results with/without using the dual modes pitch coding in the examples above. The tables show that the dual modes pitch coding approach can significantly improve speech or music coding quality when containing substantially short pitch lags. Additional listening test results also show that the speech or music quality with real pitch lag<=PIT_MIN is significantly improved after using the dual modes pitch coding.

TABLE 10

SNR for clean speech with real pitch lag > PIT_MIN.

| | 6.8 kbps | 7.6 kbps | 9.2 kbps | 12.8 kbps | 16 kbps |
|---|---|---|---|---|---|
| Based line | 6.527 | 7.128 | 8.102 | 8.823 | 10.171 |
| Dual modes | 6.536 | 7.146 | 8.101 | 8.822 | 10.182 |
| Difference | 0.009 | 0.018 | −0.001 | −0.001 | 0.011 |

TABLE 11

WsegSNR for clean speech with real pitch lag > PIT_MIN.

| | 6.8 kbps | 7.6 kbps | 9.2 kbps | 12.8 kbps | 16 kbps |
|---|---|---|---|---|---|
| Based line | 6.912 | 7.430 | 8.356 | 9.084 | 10.232 |
| Dual modes | 6.941 | 7.447 | 8.377 | 9.130 | 10.288 |
| Difference | 0.019 | 0.017 | 0.021 | 0.046 | 0.056 |

TABLE 12

SNR for noisy speech with real pitch lag > PIT_MIN.

| | 6.8 kbps | 7.6 kbps | 9.2 kbps | 12.8 kbps | 16 kbps |
|---|---|---|---|---|---|
| Based line | 5.208 | 5.604 | 6.400 | 7.320 | 8.390 |
| Dual modes | 5.202 | 5.597 | 6.400 | 7.320 | 8.387 |
| Difference | −0.006 | −0.007 | 0.000 | 0.000 | −0.003 |

TABLE 13

| WsegSNR for noisy speech with real pitch lag > PIT_MIN. | | | | | |
|---|---|---|---|---|---|
| | 6.8 kbps | 7.6 kbps | 9.2 kbps | 12.8 kbps | 16 kbps |
| Based line | 5.056 | 5.407 | 6.182 | 7.206 | 8.231 |
| Dual modes | 5.053 | 5.404 | 6.182 | 7.202 | 8.229 |
| Difference | −0.003 | −0.003 | 0.000 | −0.004 | −0.002 |

TABLE 14

| SNR for clean speech with real pitch lag <= PIT_MIN. | | | | | |
|---|---|---|---|---|---|
| | 6.8 kbps | 7.6 kbps | 9.2 kbps | 12.8 kbps | 16 kbps |
| Based line | 5.241 | 5.865 | 6.792 | 7.974 | 9.223 |
| Dual modes | 5.732 | 6.424 | 7.272 | 8.332 | 9.481 |
| Difference | 0.491 | 0.559 | 0.480 | 0.358 | 0.258 |

TABLE 15

| WsegSNR for clean speech with real pitch lag <= PIT_MIN. | | | | | |
|---|---|---|---|---|---|
| | 6.8 kbps | 7.6 kbps | 9.2 kbps | 12.8 kbps | 16 kbps |
| Based line | 6.073 | 6.593 | 7.719 | 9.032 | 10.257 |
| Dual modes | 6.591 | 7.303 | 8.184 | 9.407 | 10.511 |
| Difference | 0.528 | 0.710 | 0.465 | 0.365 | 0.254 |

Figure 10:
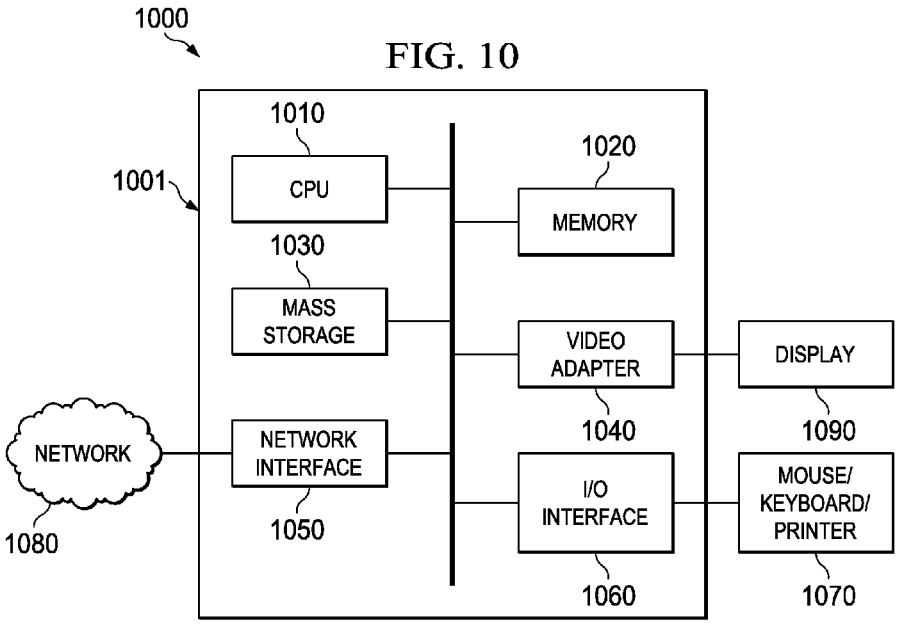
FIG. 10 is a block diagram of a processing system that can be used to implement various embodiments.

FIG. 10 is a block diagram of an apparatus or processing system 1000 that can be used to implement various embodiments. For example, the processing system 1000 may be part of or coupled to a network component, such as a router, a server, or any other suitable network component or apparatus. Specific devices may utilize all of the components shown, or only a subset of the components, and levels of integration may vary from device to device. Furthermore, a device may contain multiple instances of a component, such as multiple processing units, processors, memories, transmitters, receivers, etc. The processing system 1000 may comprise a processing unit 1001 equipped with one or more input/output devices, such as a speaker, microphone, mouse, touchscreen, keypad, keyboard, printer, display, and the like. The processing unit 1001 may include a central processing unit (CPU) 1010, a memory 1020, a mass storage device 1030, a video adapter 1040, and an I/O interface 1060 connected to a bus. The bus may be one or more of any type of several bus architectures including a memory bus or memory controller, a peripheral bus, a video bus, or the like.

The CPU 1010 may comprise any type of electronic data processor. The memory 1020 may comprise any type of system memory such as static random access memory (SRAM), dynamic random access memory (DRAM), synchronous DRAM (SDRAM), read-only memory (ROM), a combination thereof, or the like. In an embodiment, the memory 1020 may include ROM for use at boot-up, and DRAM for program and data storage for use while executing programs. In embodiments, the memory 1020 is non-transitory. The mass storage device 1030 may comprise any type of storage device configured to store data, programs, and other information and to make the data, programs, and other information accessible via the bus. The mass storage device 1030 may comprise, for example, one or more of a solid state drive, hard disk drive, a magnetic disk drive, an optical disk drive, or the like.

The video adapter 1040 and the I/O interface 1060 provide interfaces to couple external input and output devices to the processing unit. As illustrated, examples of input and output devices include a display 1090 coupled to the video adapter 1040 and any combination of mouse/keyboard/printer 1070 coupled to the I/O interface 1060. Other devices may be coupled to the processing unit 1001, and additional or fewer interface cards may be utilized. For example, a serial interface card (not shown) may be used to provide a serial interface for a printer.

The processing unit 1001 also includes one or more network interfaces 1050, which may comprise wired links, such as an Ethernet cable or the like, and/or wireless links to access nodes or one or more networks 1080. The network interface 1050 allows the processing unit 1001 to communicate with remote units via the networks 1080. For example, the network interface 1050 may provide wireless communication via one or more transmitters/transmit antennas and one or more receivers/receive antennas. In an embodiment, the processing unit 1001 is coupled to a local-area network or a wide-area network for data processing and communications with remote devices, such as other processing units, the Internet, remote storage facilities, or the like.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method for dual modes pitch coding implemented by an apparatus for speech/audio coding, the method comprising:

coding pitch lags of a plurality of subframes of a frame of a voiced speech signal using one of two pitch coding modes according to a pitch length, stability, or both, wherein the two pitch coding modes include a first pitch coding mode with relatively high pitch precision and reduced dynamic range and a second pitch coding mode with relatively high pitch dynamic range and reduced precision.

2. The method of claim 1, wherein the first pitch coding mode is used for coding pitch lags that are relatively short or substantially stable, and wherein the second pitch coding mode is used for coding pitch lags that are relatively long or relatively less stable or that are of a substantially noisy signal.

3. The method of claim 1, wherein the pitch lags are coded with relatively high precision and reduced dynamic range or with relatively large dynamic range and reduced precision in comparison to a conventional Code Excited Linear Prediction Technique (CELP) algorithm.

4. The method of claim 1 further comprising using less bits to code the pitch lags in comparison to a conventional Code Excited Linear Prediction Technique (CELP) algorithm.

5. The method of claim 1, wherein the voiced speech signal's coding has a relatively low bit rate that is less than or equal to 16 kilobits per second (kbps).

6. A method for dual modes pitch coding implemented by an apparatus for speech/audio coding, the method comprising:

determining whether a voiced speech signal has one of a relatively short pitch and a substantially stable pitch or one of a relatively long pitch and a relatively less stable pitch or is a substantially noisy signal; and coding pitch lags of the voiced speech signal with relatively high pitch precision and reduced dynamic range upon determining that the voiced speech signal has a relatively short or substantially stable pitch, or coding pitch lags of the voiced speech signal with relatively high pitch dynamic range and reduced precision upon determining that the voiced speech signal has a relatively long or less stable pitch or is a substantially noisy signal.

7. The method of claim 6 further comprising:

indicating in the coding of the pitch lags a first pitch coding mode with relatively high precision and reduced dynamic range upon determining that the voiced speech signal has a relatively short or substantially stable pitch, or indicating a second pitch coding mode with relatively large dynamic range and reduced precision upon determining that the voiced speech signal has a relatively long or less stable pitch or is a substantially noisy signal.

8. The method of claim 7, wherein the first pitch coding mode or the second pitch coding mode is indicated by one bit in the coding of the pitch lags.

9. The method of claim 7, wherein the voiced speech signal is coded using 6800 bits per second (bps) at 12.8 kilohertz (kHz) sampling frequency and comprises four subframes including a first subframe that is coded with 9 bits in addition to one bit that indicates the first pitch coding mode or the second pitch coding mode, a second subframe and a third subframe that are each coded with 4 bits, and a fourth subframe that is coded with 5 bits.

10. The method of claim 9, wherein the voiced speech signal that has a relatively short or substantially stable pitch has a pitch lag between 16 and 143, wherein each of the subframes of a frame of the voiced speech signal is coded with a pitch precision of ¼, and wherein the first subframe and the fourth subframe are coded with a pitch dynamic range of +−4 and the second subframe and the third subframe are coded with a pitch dynamic range of +−2.

11. The method of claim 9, wherein the voiced speech signal that has a relatively long or less stable pitch has a pitch lag between 34 and 128, wherein the first subframe and the fourth subframe are each coded with a pitch precision of ¼ and the second subframe and the third subframe are each coded with a pitch precision of ½, and wherein each of the subframes is coded with a pitch dynamic range of +−4.

12. The method of claim 9, wherein the voiced speech signal that has a relatively long or less stable pitch has a pitch lag between 128 and 160, wherein the first subframe, the second subframe, and the third subframe are coded with a pitch precision of ½ and the fourth subframe is coded with a pitch precision of ¼, and wherein each of the subframes is coded with a pitch dynamic range of +−4.

13. The method of claim 9, wherein the voiced speech signal that has a relatively long or less stable pitch has a pitch lag between 160 and 231, wherein the first subframe is coded with a pitch precision of 1, the second subframe and the third subframe are coded with a pitch precision of ½, and the fourth subframe is coded with a pitch precision of ¼, and wherein each of the subframes is coded with a pitch dynamic range of +−4.

14. The method of claim 7, wherein the voiced speech signal is coded using 7600 bits per second (bps) at 12.8 kilohertz (kHz) sampling frequency and comprises four subframes including a first subframe that is coded with 9 bits in addition to one bit that indicates the first pitch coding mode or the second pitch coding mode, a second subframe and a third subframe that are each coded with 3 bits, and a fourth subframe that is coded with 4 bits.

15. The method of claim 14, wherein the voiced speech signal that has a relatively short or substantially stable pitch has a pitch lag between 16 and 143, wherein each of the subframes is coded with a pitch precision of ¼, and wherein the first subframe is coded with a pitch dynamic range of +−4, the second subframe and the third subframe are coded with a pitch dynamic range of +−1, and the fourth subframe is coded with a pitch dynamic range of +−2.

16. The method of claim 14, wherein the voiced speech signal that has a relatively long or less stable pitch has a pitch lag between 34 and 128, wherein the first subframe is coded with a pitch precision of ¼ and the second subframe, the third subframe, and the fourth subframe are coded with a pitch precision of ½, and wherein the first subframe and the fourth subframe are coded with a pitch dynamic range of +−4 and the second subframe and the third subframe are coded with a pitch dynamic range of +−2.

17. The method of claim 14, wherein the voiced speech signal that has a relatively long or less stable pitch has a pitch lag between 128 and 160, wherein the first subframe and the fourth subframe are coded with a pitch precision of ½ and the second subframe and the third subframe are coded with a pitch precision of 1, and wherein each of the subframes is coded with a pitch dynamic range of +−4.

18. The method of claim 14, wherein the voiced speech signal that has a relatively long or less stable pitch has a pitch lag between 160 and 231, wherein the first subframe, the second subframe, and the third subframe are coded with a pitch precision of 1 and the fourth subframe is coded with a pitch precision of ½, and wherein each of the subframes sis coded with a pitch dynamic range of +−4.

19. The method of claim 7, wherein the voiced speech signal is coded using 9200 bits per second (bps) or more at 12.8 kilohertz (kHz) sampling frequency and comprises four subframes including a first subframe that is coded with 9 bits in addition to one bit that indicates the first pitch coding mode or the second pitch coding mode, a second subframe that is coded with 4 bits, and a third subframe and a fourth subframe that are each coded with 5 bits.

20. The method of claim 19, wherein the voiced speech signal that has a relatively short or substantially stable pitch has a pitch lag between 16 and 143, wherein each of the subframes is coded with a pitch precision of ¼, and wherein the first subframe, the third subframe, and the fourth subframe are coded with a pitch dynamic range of +−4 and the second subframe is coded with a pitch dynamic range of +−2.

21. The method of claim 19, wherein the voiced speech signal that has a relatively long or less stable pitch has a pitch lag between 34 and 128, wherein the first subframe, the second subframe, and the third subframe are coded with a pitch precision of ¼ and the second subframe is coded with a pitch precision of ½, and wherein each of the subframes is coded with a pitch dynamic range of +−4.

22. The method of claim 19, wherein the voiced speech signal that has a relatively long or less stable pitch has a pitch lag between 128 and 160, wherein the first subframe and the second subframe are coded with a pitch precision of ½ and the second subframe and the third subframe are coded with a pitch precision of ¼, and wherein each of the subframes is coded with a pitch dynamic range of +−4.

23. The method of claim 19, wherein the voiced speech signal that has a relatively long or less stable pitch has a pitch lag between 160 and 231, wherein the first subframe is coded with a pitch precision of 1, the second subframe is coded with a pitch precision of ½, and the third subframe and the fourth subframe are coded with a pitch precision of ¼, and wherein each of the subframes sis coded with a pitch dynamic range of +−4.

24. An apparatus that supports dual modes pitch coding, comprising:

a processor; and a computer readable storage medium storing programming for execution by the processor, the programming including instructions to:

determine whether a voiced speech signal has one of a relatively short pitch and a substantially stable pitch or has one of a relatively long pitch and a relatively less stable pitch or is a substantially noisy signal; and code pitch lags of the voiced speech signal with relatively high precision and reduced dynamic range upon determining that the voiced speech signal has a relatively short or substantially stable pitch, or coding pitch lags of the voiced speech signal with relatively large dynamic range and reduced precision upon determining that the voiced speech signal has a relatively long or less stable pitch or is a substantially noisy signal.

25. The apparatus of claim 24, wherein the programming further includes instructions to:

indicate in the coding of the pitch lags a first pitch coding mode with relatively high precision and reduced dynamic range upon determining that the voiced speech signal has a relatively short or substantially stable pitch, or indicating a second pitch coding mode with relatively large dynamic range and reduced precision upon determining that the voiced speech signal has a relatively long or less stable pitch or is a substantially noisy signal, wherein the first pitch coding mode or the second pitch coding mode is indicated by one bit in the coding of the pitch lags.

* * * * *

UNITED STATES PATENT AND TRADEMARK OFFICE

CERTIFICATE OF CORRECTION

PATENT NO. : 9,015,039 B2
APPLICATION NO. : 13/724700
DATED : April 21, 2015
INVENTOR(S) : Gao It is certified that error appears in the above-identified patent and that said Letters Patent is hereby corrected as shown below:

On the Title Page, item (54) and in the Specification, Col. 1, line 1-2, delete "Adaptive Encoding Pitch Lag for Voiced Speech" and insert --Adaptively Encoding Pitch Lag for Voiced Speech--.

In the Claims

Col. 16, line 27, claim 18, delete "subframes sis" and insert --subframes is--.
Col. 16, line 66, claim 23, delete "subframes sis" and insert --subframes is--.

Signed and Sealed this
Twenty-fifth Day of August, 2015

Michelle K. Lee

Michelle K. Lee
*Director of the United States Patent and Trademark Office*